United States Patent [19]

McKenna

[11] 4,126,902

[45] Nov. 28, 1978

[54] BELT TYPE WEAPON

[76] Inventor: Raymond F. McKenna, 5599 N. W. 5th St., Apt. 34, Miami, Fla. 33126

[21] Appl. No.: 693,337

[22] Filed: Jun. 7, 1976

Related U.S. Application Data

[63] Continuation of Ser. No. 622,044, Oct. 14, 1975, abandoned.

[51] Int. Cl.[2] ..... A41F 3/02

[52] U.S. Cl. ..... 2/338; 2/339

[58] Field of Search ..... 2/300, 311, 321, 322, 2/325, 338, 339; 224/5 A; 119/96, 106, 109

[56] References Cited

U.S. PATENT DOCUMENTS

| | | | |
|---|---|---|---|
| 695,427 | 3/1902 | Davis | 119/107 |
| 1,803,266 | 4/1931 | Martin | 2/339 |

*Primary Examiner*—G. V. Larkin

[57] ABSTRACT

A belt for normal wear about the girth of a wearer which may be removed and used as a weapon which includes a first and a second belt length the inner ends of which are connected by a chain and the outer ends of which are adapted for hooked-up engagement and include a heavy buckle, so that one end of the belt may be held to swing the heavy buckle using the belt as a weapon.

8 Claims, 5 Drawing Figures

BELT TYPE WEAPON

This application is a continuation application of U.S. Ser. No. 622,044, filed Oct. 14, 1975 for a Belt Type Weapon, now abandoned.

FIELD OF THE INVENTION

This invention relates to a belt and, more particularly, to a belt which is adapted to be worn by a wearer as any other belt but which may also be removed and used as a weapon.

BACKGROUND OF THE INVENTION

As is perhaps well known, in the martial arts, use is taught of a device known as a nunchuka, which comprises a first and second length of wood which are interconnected by a flexible tether or chain. This invention is of a belt which may be used in a manner somewhat similar to a nunchuka. It includes a first and second belt length which are interconnected by a chain. On one end of the belt is a heavy object, in the form of a buckle. The belt may be removed by the wearer, the other end of the belt wrapped around the wearer's hand and the heavy object swung and manipulated as a weapon.

It is, accordingly, an object of this invention to provide a belt which may be removed and used as a weapon in a fashion resembling use of the nunchuka.

In accordance with these and other objects which will become apparent hereinafter, the instant invention will now be described with reference to the accompanying drawings in which:

DESCRIPTION OF PREFERRED EMBODIMENT

Figure 1:
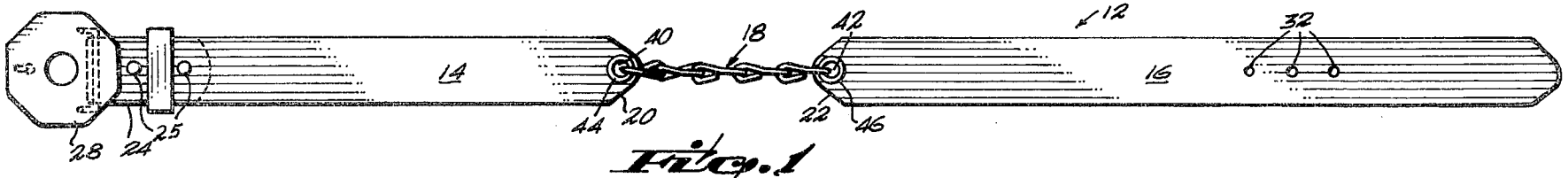
FIG. 1 is a plan view of a belt constructed in accordance with the present invention.
Figure 2:
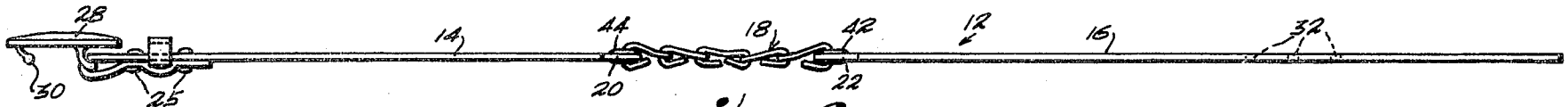
FIG. 2 is a side elevation view of the belt shown in FIG. 1.

Referring to the drawings wherein like reference characters designate like or corresponding parts throughout the several views, there is shown in FIG. 1 a belt generally designated by the numeral 12 which includes a first and second elongate belt segment 14 and 16 which are interconnected by a chain means 18 which connects their respective inner belt segment ends 20 and 22. To the outer end 24 of the belt segment 14 a relatively heavy belt buckle of brass or other suitable material 28 is connected as by rivets 25. The buckle is provided with hook means 30 for hooked-up engagement with a plurality of openings such as those designated by the numeral 32 in the other belt segment. The chain length 18 interconnects the inner ends of the belt segments and is attached to them by suitable means such as at the openings 40 and 42 which may have margins which are reinforced as by the grommets 44 and 46.

Figure 3:
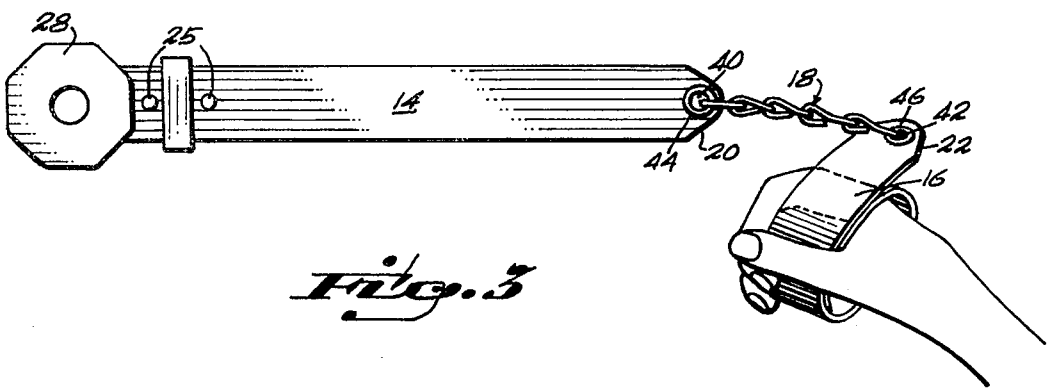
FIG. 3 is a view illustrating a use of the belt.

It is thus seen that the belt may be removed and used as a weapon as seen in FIG. 3 by wrapping the belt segment 16 about the hand and swinging the chain connected heavy buckle carrying end or segment 14.

Figure 4:
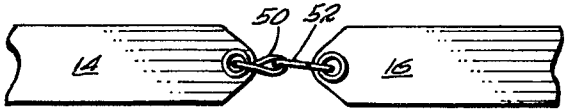
FIG. 4 is an alternative embodiment of the instant invention.
Figure 5:
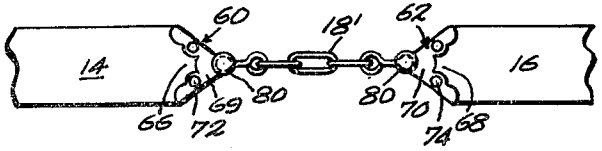
FIG. 5 is a second alternative embodiment of the belt.

Alternative construction is shown in FIGS. 4 and 5. In FIG. 4 the chain may be a relatively short number of links, such as that designated by the numeral 50 and 52. Additionally, as shown in FIG. 5 other types of fastener means such as 60 and 62 may be used to connect the chain to the inner ends 66 and 68 of the belt segments. In the embodiment shown in FIG. 5 metal clasps 69 and 70 are provided which are riveted as at 72 and 74 through the belt and clasp. Additionally, swivel joints or swivel-type connected means 80 are provided connecting the clasps and the chain portion 18'.

It is thus seen that in either embodiment, the user simply removes the belt when defense is necessary, wraps the segment of the belt 16 about his hand and may use the heavy buckle in swinging movements as a weapon. Alternatively, it may be used by holding one of the belt segments in each hand and using the belt in a defensive manner to block.

What is claimed is:

1. A belt which may be used as a weapon which includes a first elongate length and a second elongate length, each having a longitudinal centerline and each having an inner end and an outer end, means linking the inner ends of the lengths, said means having a longitudinally extending centerline and a first end and a second end, means interconnecting said first end to said inner end of said first length at the longitudinal centerline and interconnecting the second end to said inner end of said second length at the longitudinal centerline, and said interconnected belt lengths and means linking being of an overall length to encircle the girth of a wearer, fastener means including a first heavy member on the outer end of the first elongated length and companionate means for hooked-up connection to the fastener means on the other end of the second elongate length.

2. The device as set forth in claim 1 wherein said linking means are of a predetermined length less than that of the length of said first elongate length and less than the length of said second elongate length.

3. The device as set forth in claim 2 wherein said linking means includes a first end and a second end and means on the first end to connect to the inner end of said first belt length and means on the second end to connect to the inner end of said second belt length.

4. The device as set forth in claim 1 wherein said linking means includes a first end and a second end and means on the first end to connect to the inner end of said first belt length and means on the second end to connect to the inner end of said belt length.

5. The device as set forth in claim 1 wherein said means linking comprises a length of interconnected chain links.

6. The device as set forth in claim 1 wherein reinforcing means are provided at the connections of the means linking and the lengths.

7. The device as set forth in claim 1 wherein said means interconnecting comprise swivel connection means.

8. The device as set forth in claim 1 wherein said fastener means includes a heavy buckle.

* * * * *